United States Patent [19]

Parker

[11] Patent Number: 4,646,375

[45] Date of Patent: Mar. 3, 1987

[54] BED SHEET FASTENER

[76] Inventor: Robert W. Parker, 2424 Tustin Ave. #F1, Santa Ana, Calif. 92705

[21] Appl. No.: 745,463

[22] Filed: Jun. 17, 1985

[51] Int. Cl.[4] ..... A47C 21/02; A47G 9/02

[52] U.S. Cl. ..... 5/498; 5/496; 5/485

[58] Field of Search ..... 5/402, 485, 494–498

[56] References Cited

U.S. PATENT DOCUMENTS

| | | | |
|---|---|---|---|
| 3,996,633 | 12/1976 | Burke | 5/497 |
| 4,040,133 | 8/1977 | Gilreath | 5/496 |
| 4,045,831 | 9/1977 | Clark | 5/485 |
| 4,057,862 | 11/1977 | LaBianco | 5/496 |
| 4,391,010 | 6/1983 | Krorman | 5/485 |

FOREIGN PATENT DOCUMENTS

| | | | |
|---|---|---|---|
| 459033 | 8/1949 | Canada | 5/496 |
| 1123872 | 10/1956 | France | 5/496 |

*Primary Examiner*—Gary L. Smith
*Assistant Examiner*—Michael F. Trettel
*Attorney, Agent, or Firm*—Morland C. Fischer

[57] ABSTRACT

A reliable fastener to quickly and easily secure a flat sheet around the mattress of a bed, particularly a water bed, to prevent an inadvertent removal of the sheet from the mattress. First and second complementary pieces of adhesive material are arranged at each of the corners of the sheets and at areas of the bed frame over which the mattress corners are laid. A pocket is associated with each of the sheet corners to enable the user to insert his hand therein and guide a first piece of adhesive at the sheet corner into mating and releasable engagment with a second piece of adhesive at the bed frame.

7 Claims, 6 Drawing Figures

BED SHEET FASTENER

BACKGROUND OF THE INVENTION

1. Field of the Invention

This invention relates to a bed sheet fastener by which a flat water bed sheet, or the like, can be removable secured to the frame of a water bed to prevent an inadvertent removal of the sheet from the mattress over which the sheet is placed.

2. Prior Art

As will be known to the owners and users of a water bed, it is frequently difficult to prevent the inadvertent removal of a sheet from the water bed mattress. That is, the weight of the user displaces water within the mattress which often causes the corners of the sheet to pull away from the corners of the mattress. During sleep, the movement of the user across the mattress also tends to remove the sheet. In some cases, the water bed user may find himself lying on the water filled mattress with the sheet completely removed therefrom.

Therefore, it is a principal object of this invention to provide a reliable fastener by which a water bed user may prevent the inadvertent removal of a sheet from the mattress of a water bed.

It is another object of this invention that the fastener be of low cost and adapted for use with any size sheet for any corresponding water bed.

It is yet another object of this invention to enable the user, with a minimum of difficulty and effort, to cover the water bed mattress with a sheet.

It is still another object of this invention that the fastener be able to removably secure corners of the sheet to the water bed frame.

It is yet another object of this invention that the fastener be adapted for quick and easy use, for both attaching the sheet to and removing the sheet from the water bed frame.

SUMMARY OF THE INVENTION

Briefly, and in general terms, a reliable fastener is disclosed by which to enable a user of a water bed to easily and securely attach a flat water bed sheet over a water bed mattress and thereby prevent an inadvertent removal of the sheet from the mattress. Each corner of the sheet is provided with a receptacle which is shaped and dimensioned so as to receive a corresponding corner of the mattress. Attached to each corner receptacle of the sheet is a pocket, one end of which is open. A first piece of adhesive material (e.g. VELCRO) is affixed to each pocket. A second and complementary piece of adhesive material is affixed to respective portions of the water bed mattress support frame over which each of the corners of the water bed mattress are laid.

In operation, the user inserte his hand into a pocket through the open end thereof. The associated corner receptacle of the sheet is then positioned around a corner of the mattress. With his hand still in the pocket, the user then guides the first piece of adhesive material at the pocket into mating engagement with the second piece of adhesive material at the mattress support frame. The user then removes his hand from the pocket with the adhesive pieces remaining fastened together and the corner of the bed sheet removably attached to the support frame. The user repeats the aforementioned attachment operation for the three remaining corners of the sheet. With the sheet removably attached to the support frame, there is less likelihood that the sheet can be inadvertently pulled loose and removed from the mattress. However, to remove the sheet from the mattress, the user simply detaches the complementary adhesive pieces from one another.

DESCRIPTION OF THE PREFERRED EMBODIMENT

Figure 1:
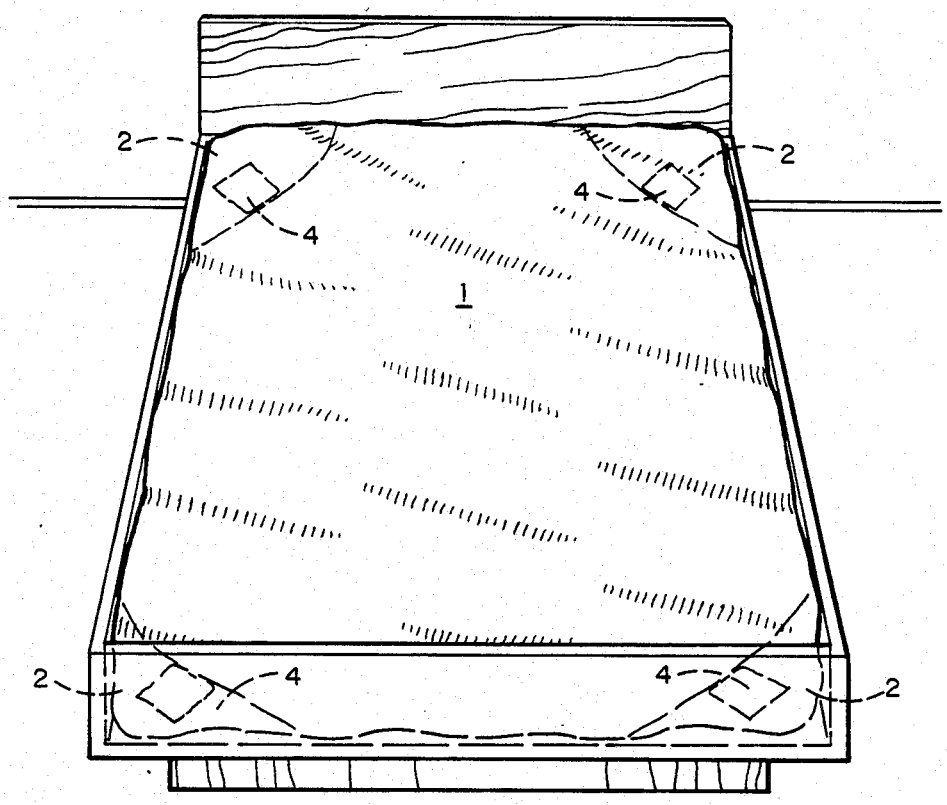
FIG. 1 is a front elevation of a water bed having a flat sheet removably secured around a mattress thereof by virtue of the present invention.
Figure 2:
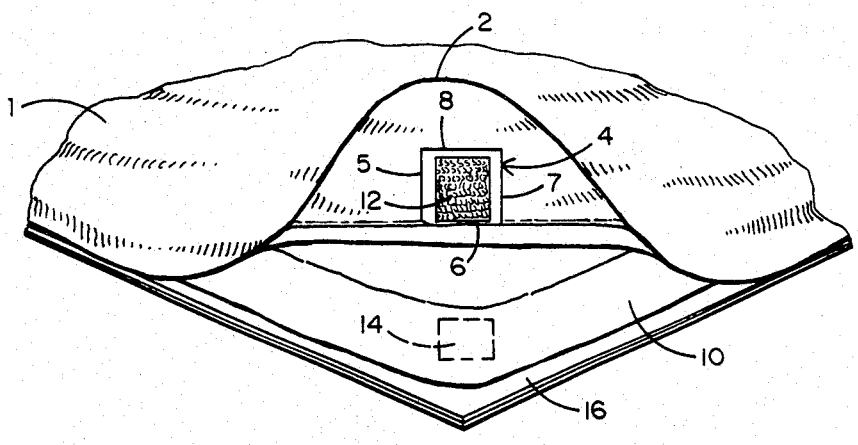
FIG. 2 shows a corner of the water bed of FIG. 1 and the bed sheet fastener which forms the present invention.

Reference is now made to FIGS. 1 and 2 of the drawings in order that the present invention can be described in detail. A flat (e.g. bottom) sheet 1, such as that having dimensions to cover the mattress 10 of a water bed, or the like, is shown with the four corners thereof including respective, generally cone-shaped receptacles 2. Each of the corner receptacles 2 is preferably formed from an elastic material, such as, for example, that known as SPANDEX. The corner receptacles 2 of sheet 1 have suitable dimensions whereby to receive therewithin corresponding corners of the water bed mattress 10 so that the bed sheet 1 may be fitted over and around mattress 10.

In accordance with the present invention, a pocket 4 is attached (e.g. sewn) to each of the corner receptacles 2 of sheet 1. The pockets 4 may be fabricated from the same material which is used to form the corner receptacles 2. Each pocket 4 has three closed ends 5, 6 and 7 and a fourth open end 8. The pocket 4 is preferably located so that one of the closed ends 6 is in alignment with the edge which forms the base of the cone-shaped corner receptacle 2. The open pocket end 8 is aligned opposite the closed pocket end 6.

A first piece 12 of adhesive material is attached (e.g. sewn) to the face of each pocket 4. By way of example, the adhesive material of piece 12 may be a well-known material, such as VELCRO. A second and complementary piece 14 of material (e.g. also VELCRO) is attached (e.g. by means of commercially available VELCRO adhesive) to respective portions of the water bed support frame over which each of the four corners of the water bed mattress 10 is laid. Thus, in the preferred embodiment, the first and second complementary pieces 12 and 14 of VELCRO material are adapted to be removably mated together so as to fasten the adhesive piece 12 at pocket 4 to the adhesive piece 14 at frame 16 in a manner which will now be described.

Figure 3:
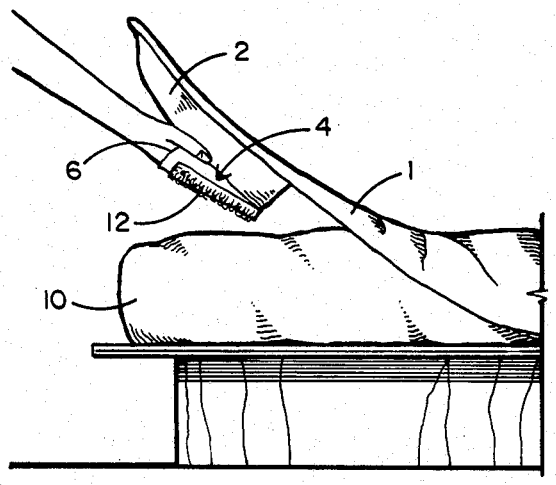
FIGS. 3–6 are illustrative of the preferred steps for using the bed sheet fastener of the present invention to quickly and easily secure a sheet over the mattress.
Figure 4:
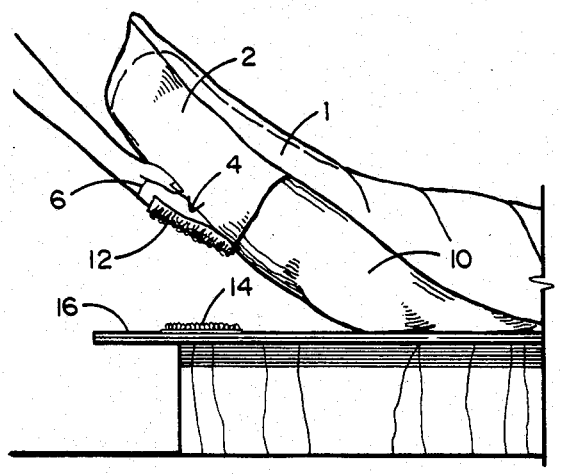

The use of the presently disclosed bed sheet fastener is best described while referring concurrently to FIGS. 3, 4, 5 and 6 of the drawings. In order to quickly and easily attach the fitted (e.g. bottom) bed sheet 1 over and around the corners of a water bed mattress 10, the user first lays the sheet 1 across the mattress 10 and inserts his hand into one of the pockets 4 through the opened end 6 thereof (FIG. 3). Next, the user raises one of the corners of the mattress 10 off its support frame 16 to expose the adhesive piece 14 lying thereunder. With his hand still in pocket 4, the user guides the associated corner receptacle 2 of sheet 1 around and into receipt of the raised corner of the mattress 10 (FIG. 4). However, it is also to be recognized that as a distinct advantage of the present invention, the user does not have to raise the corner of the mattress when guiding the corner receptacle 2 therearound. In this case, the user merely slides his hand between mattress 10 and frame 16.

Figure 5:
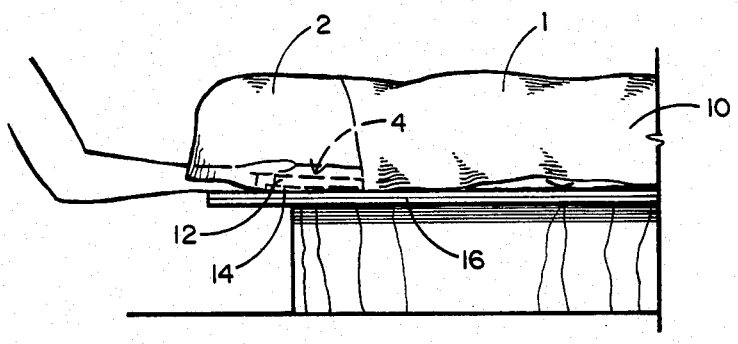
Figure 6:
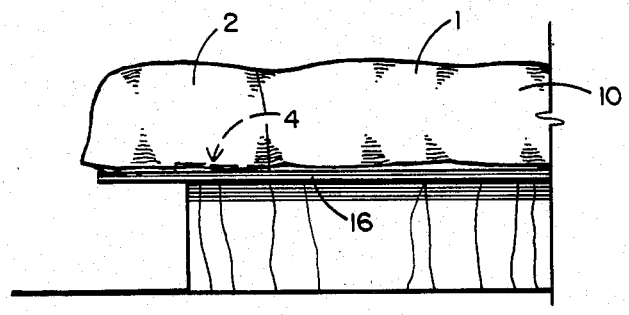

After the corner receptacle 2 of sheet 1 has been fitted over the raised corner of mattress 10, the user lowers the previously raised corner so that the adhesive piece 12 at pocket 4 is moved into mating engagement with the adhesive piece 14 at mattress support frame 16 (FIG. 5). Then, the user is able to remove his hand from the pocket 4 with the adhesive pieces 12 and 14 remaining fastened together (FIG. 6).

The fastening method illustrated in FIGS. 3–6 is repeated in order to conveniently attach the bed sheet over each of the three remaining corners of the water bed mattress. By virtue of the complementary adhesive pieces 12 and 14, each of the corners of the sheet may be removably attached to the mattress support frame 16, so as to reduce the likelihood that the sheet may be inadvertently separated from the mattress, whereby to overcome a problem commonly associated with conventional wafer bed sheets. However, to remove the sheet from the mattress, the user need only detach the adhesive pieces 12 and 14 from one another so that the sheet may be pulled away from the mattress.

It will be apparent that while a preferred embodiment of the invention has been shown and described, various modifications and changes may be made without departing from the true spirit and scope of the invention. For example, while the present bed sheet fastener has been described as having particular application to a water bed, this is not to be regarded as a limitation of the claimed invention. That is, the sheet fastener may be associated with any other mattress or bed, such as, for example, a well-known fiber stuffed mattress (e.g. including a child's crib mattress) for which extended amounts of time and energy are frequently spent in order to properly attached and secure a conventional sheet thereto. Moreover, the second piece of adhesive material 14 may be attached to any mattress support, such as the floor, a box spring support, or the like.

Having thus set forth a preferred embodiment of the present invention, what is claimed is:

1. A bed sheet with means to removably secure said sheet over a mattress in which to receive a corresponding corner of the mattress, said securing means further comprising pocket means secured to said receptacle and having at least two closed sides and an open end through which a user can insert his hand to guide said receptacle into receipt of a corresponding mattress corner, a first attachment means located on said pocket means and a second attachment means located under said corresponding mattress corner, said first and second attachment means being moved into engagement with one another when said mattress corner is guided from said pocket means into receipt of said corner receptacle.

2. The bed sheet recited in claim 1, wherein each of said first and second attachment means is an adhesive material.

3. The bed sheet recited in claim 1, wherein said first and second attachment means are formed from respective hook and loop fastener materials.

4. The bed sheet recited in claim 1, wherein the mattress is laid upon a mattress support, said second attachment means connected to said mattress support under said corresponding mattress corner.

5. The bed sheet recited in claim 1, wherein the open end of said pocket means to receive the user's hand and the open end of said corner receptacle to receive said corrsponding mattress corner face in opposite directions relative to one another.

6. The bed sheet recited in claim 1, wherein said corner receptacle is formed from an elastic material.

7. The bed sheet recited in claim 1, wherein said pocket means is formed from an elastic material.

* * * * *

UNITED STATES PATENT AND TRADEMARK OFFICE

CERTIFICATE OF CORRECTION

PATENT NO. : 4,646,375

DATED : March 3, 1987

INVENTOR(S) : Robert W. Parker

It is certified that error appears in the above—identified patent and that said Letters Patent is hereby corrected as shown below:

Claim 1, Line 2, after "mattress" insert --, said securing means comprising a receptacle formed at a corner of said sheet --.

Signed and Sealed this

Fifteenth Day of December, 1987

*Attest:*

DONALD J. QUIGG

*Attesting Officer*

*Commissioner of Patents and Trademarks*